United States Patent [19]

Le Lande, Jr.

[11] Patent Number: 4,936,388

[45] Date of Patent: Jun. 26, 1990

[54] FIRE SUPPRESSION SYSTEM

[76] Inventor: Walter C. Le Lande, Jr., 301 N. Hart Place, Fullerton, Calif. 92631

[21] Appl. No.: 268,807

[22] Filed: Nov. 8, 1988

Related U.S. Application Data

[63] Continuation of Ser. No. 908,808, Sep. 17, 1986, Pat. No. 4,836,290.

[51] Int. Cl.[5] ..... A62C 3/00

[52] U.S. Cl. ..... 169/46; 169/61; 169/43; 169/11; 98/42.03

[58] Field of Search ..... 169/11, 43, 46, 61; 98/42.03, 1, 121.2

[56] References Cited

U.S. PATENT DOCUMENTS

| | | | |
|---|---|---|---|
| 938,067 | 10/1909 | Maranville | 98/42.03 |
| 1,117,287 | 11/1914 | Warden | 98/42.03 |
| 2,207,662 | 7/1940 | Edmundson | 169/11 |
| 3,543,439 | 12/1970 | Pantland | 98/121.2 |
| 3,829,010 | 8/1974 | Jones | 98/42.03 |
| 3,862,718 | 1/1975 | Butler | 169/61 |
| 4,330,040 | 5/1982 | Ence et al. | 169/16 |
| 4,432,272 | 2/1984 | Becelaere | 98/1 |
| 4,625,626 | 12/1986 | Aalto et al. | 98/1 |
| 4,723,481 | 2/1988 | Hart et al. | 98/1 |

*Primary Examiner*—Joseph F. Peters, Jr.
*Assistant Examiner*—Anne Sartelle
*Attorney, Agent, or Firm*—Fay, Sharpe, Beall, Fagan, Minnich & McKee

[57] ABSTRACT

A fire extinguishing system for roof fires or the like includes a fire sensor for monitoring a condition indicative of a fire and for signaling the sensing of the condition. A first fire extinguishing member is provided for spraying a fire retardant fluid onto an exterior surface of an associated roof. A logic circuit is connected to the fire sensor and the first fire extinguishing member for actuating the first fire extinguishing member as driven by the fire sensor.

14 Claims, 2 Drawing Sheets

3B
3B
A
B
C
D
10
12
14
20
21
22
23
24
26
28
30
31
32
34
36
38
40
50
52
53
54
56
58
60
62
64
66
70
72
80
82
84
86
88
90
92

FIRE SUPPRESSION SYSTEM

"This is a continuation of co-pending application Ser. No. 908,808 filed on Sept. 17, 1986, now U.S. Pat. No. 4,836,290."

BACKGROUND OF THE INVENTION

This invention generally pertains to fire suppression systems. More specifically, the present invention relates to a fire suppression system for a building roof.

The invention is particularly applicable to fire suppression systems for wood shake, or shingle roofs. However, it will be appreciated by those skilled in the art, that the invention has broader application and may also be adapted for use in many other fire suppression environments.

Wood shakes and shingles are frequently used as roofing materials due to their attractive appearance. Usually such shakes or shingles are made of untreated cedar which dries out and, becomes extremely flammable a few years after installation. Even when such shakes are treated with a fire suppressant chemical before installation, the shakes still dry out in a few years and become quite flammable. Such roofs in the drier southwestern and western areas of the United States are frequently dangerous fire hazards.

Wood shake roofs used on multi-unit residential dwellings in the dry regions of the sunbelt, such as in southern California, where numerous brush fires burn every year, are particularly dangerous. For example, in Apr., 1982 a 364 unit apartment complex in Anaheim, Calif. was destroyed by fire after a spark generated from lightning that struck a major electrical transformer started the cedar shake roofs of the apartment complex on fire. The complex had burned to the ground by the time the fire department arrived. Another fire related disaster occurred in Dallas in March of 1983. A large apartment complex having over 850 units was partially destroyed by fire when a faulty wiring system shorted out in the ceiling joists of one of the buildings and the sparks ignited the wood shingled roof. The flames spread quickly to all the roofs of the apartment complex and by the time the fire department arrived, 200 units of the complex had burned to the ground. There were also numerous injuries to firefighters and tenants, luckily, none were life threatening.

While several fire suppression systems are known for buildings and some chemical fire retardant treatment processes are known for wood shake roofs, none of these has been found to be entirely satisfactory in preventing the ignition and burning of wood shake or shingle roofs.

Accordingly, it has been considered desirable to develop a new and improved fire suppression system for wood shake and shingle roofs which would overcome the foregoing difficulties and others while providing better and more advantageous overall results.

BRIEF SUMMARY OF THE INVENTION

In accordance with the invention, a new and improved fire suppression system is provided for roof fires or the like.

More particularly in accordance with this aspect of the invention, a fire sensor means is provided for monitoring a condition indicative of a fire and for signaling a sensing of the condition. A first fire extinguishing means is provided for spraying a fire retardant fluid onto an exterior surface of an associated roof. A logic circuit is connected to the fire sensor means and the first fire extinguishing means for actuating the first fire extinguishing means as driven by the fire sensor means.

In accordance with another aspect of the invention, the system further comprises a manually operatable control means for overriding the logic circuit and activating the first fire extinguishing means.

According to another aspect of the invention, the system further comprises a second fire extinguishing means for injecting a fire retardant gas in an associated attic located under the associated roof.

In accordance with still another aspect of the invention, the system further comprises at least one ventilation fan for selectively circulating air through the associated attic under the associated roof when no fire condition is sensed. Preferably, a closure means is provided for closing an air intake of the at least one ventilation fan with the closure means being activated by the logic circuit. In the preferred embodiment, two spaced ventilation fans are provided to allow better circulation of air through the associated attic.

In accordance with yet another aspect of the invention, the first fire extinguishing means comprises a spray nozzle, a fluid circuit, a fire retardant fluid holding tank, and valve means for controlling the flow of a fire retardant fluid from the holding tank through the fluid circuit to the spray nozzle. Preferably, the first fire extinguishing means further comprises a source of water and a water conduit connecting the source of water to the fluid circuit. A mixing means, which is located in the fluid circuit, is also provided for mixing the water from the source of water with the fire retardant fluid before the mixture exits through the spray nozzle. The source of water can be provided by a conventional water supply or an emergency water supply.

In accordance with yet another aspect of the invention, the system further comprises an emergency power supply for powering the logic circuit even during power outages.

According to another aspect of the invention, a method is provided for extinguishing a fire on a wood shingle or shake roof.

More particularly in accordance with this aspect of the invention, the method comprises the step of sensing a fire condition and actuating a closure means for sealing an attic beneath the wood shingle roof against the inflow of air. A fire retardant mixture is then sprayed onto the exterior surface of the wood shingle roof to extinguish or suppress a roof fire.

In accordance with another aspect of the invention, the method comprises the further step of injecting a fire retardant gas into the attic.

One advantage of the present invention is the provision of an effective and fast acting fire suppression system for wood shingle or shake roofs to retard the combustion thereof.

Another advantage of the present invention is its provision of a fire sensor for monitoring a condition indicative of a fire and a logic circuit connected to the fire sensor and to a liquid fire extinguisher system for actuating the fire extinguisher system as driven by the fire sensor.

Yet another advantage of the invention is the provision of a fire extinguishing system that provides for the spraying of a fire retardant fluid onto an exterior surface of the wood shingle or shake roof to retard the combustion thereof.

Still another advantage of the present invention is its provision of a manually operable control means for overriding the logic circuit and activating the first fire extinguisher.

A further advantage of the present invention is the provision of a second fire extinguishing means for injecting a fire retardant gas into the attic under the roof to retard combustion.

Yet still another advantage of the present invention is the provision of a sealed attic in which at least one, and preferably two, ventilation fans are provided for selectively circulating air through the attic when no fire condition is sensed. An air intake of the ventilation fan is closed by a closure means when a fire condition is sensed. The closure means is activated by the logic circuit.

An additional advantage of the present invention is the provision of a fire extinguishing means which comprises a fire retardant fluid provided in a holding tank, a fluid circuit preferably containing water, a mixing device for mixing the fire retardant fluid with water, and a spray nozzle through which the mixture of fire retardant fluid and water can be ejected onto the roof.

A still further advantage of the present invention is the provision of an emergency power supply for powering the logic circuit even during power outages.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts a preferred embodiment of which will be described in detail in this specification and illustrated in the accompanying drawings which form a part thereof and wherein.

DETAILED DESCRIPTION OF THE PREFERRED EMBODIMENT

Figure 1:
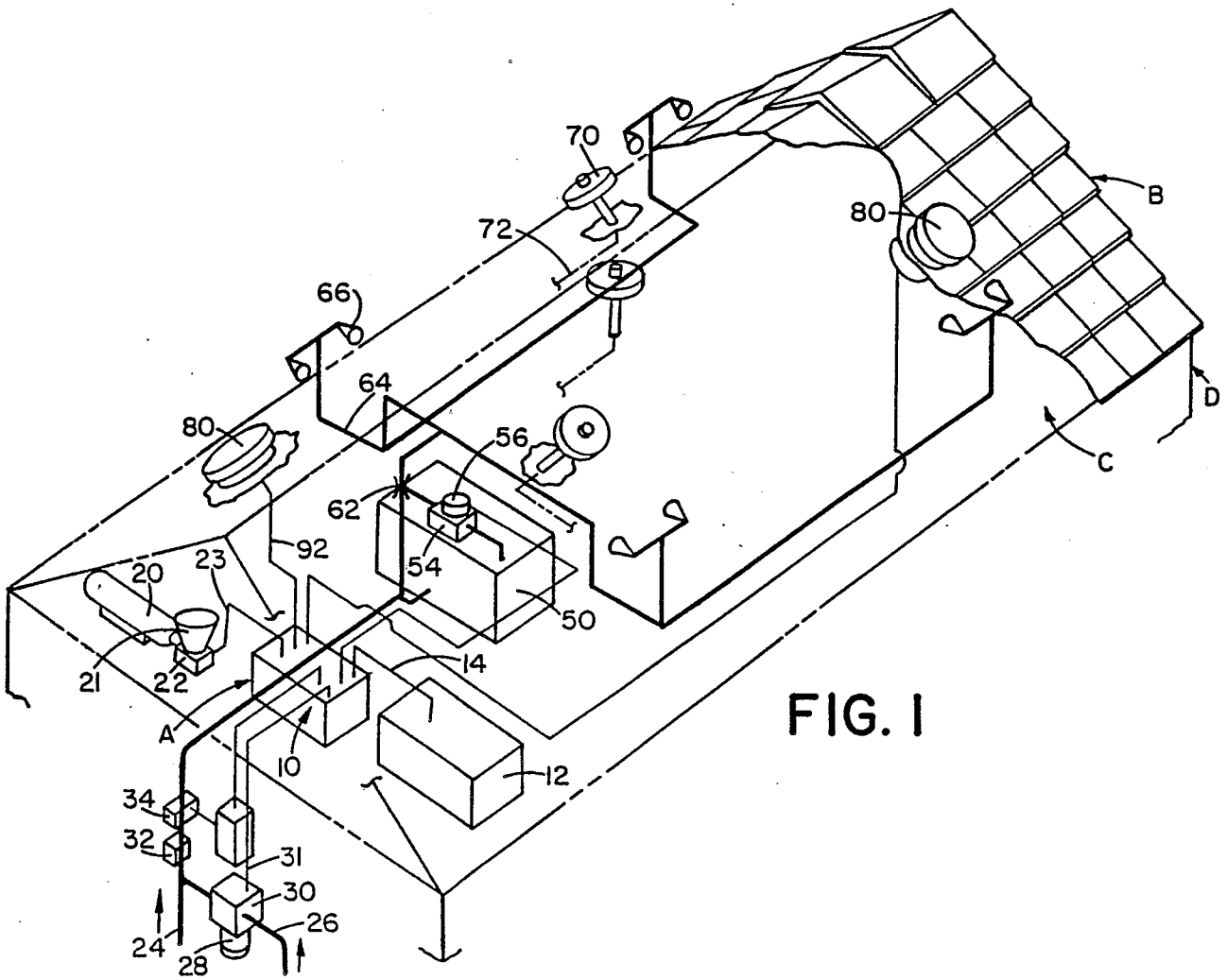
FIG. 1 is a schematic perspective view, partially broken away, of a fire suppression system and an associated roof according to the present invention.

Referring now to the drawings wherein the showings are for purposes of illustrating a preferred embodiment of the invention only and not for purposes of limiting same, FIG. 1 shows the subject new fire suppression system A in schematic form positioned on a roof B overlying an attic C of a multi-unit buidling D. While the fire suppression system is primarily designed for and will hereinafter be described in connection with the suppression of fires occurring in wood roof shingles or shakes, it will be appreciated that the overall inventive concept involved could be adapted for use in other fire suppression environments as well.

More particularly, the fire suppression system A comprises a control means 10, which can be a microcomputer or the like, and functions as the nerve center of the system. The control means 10 can be powered by the conventional electrical supply of the building D. If a fire occurs, however, such electrical supply may be interrupted. In order to provide power for the control means 10 in the event of such an emergency, a conventional auxiliary power source 12 is also provided. A wiring connection 14 leads from the auxiliary power source to the control means.

A tank 20 of fire suppressant gas, such as $CO_2$, is also provided and is positioned in the attic C of the building D. The tank includes a nozzle 21 and a valve 22 which is actuated from the control means 10 by a lead wire 23. The function of the fire suppressant gas is to forestall or suppress any fires that may spread into the attic C.

A water pipe 24 leads from the building's regular water supply to the attic. In case this supply is interrupted, such as by low water pressure during a fire, an auxiliary water supply pipe 26 is also provided. This pipe may provide water from an auxiliary source of water such as a swimming pool of the preferably multi-dwelling building D. In order to pull the water from the auxiliary water supply up to the attic, a pump 28 is provided in the auxiliary water supply circuit. A valve means 30 controlled by the control means 10 actuates the pump 28 once it is sensed that water is not flowing through the pipe 24 from the conventional water supply. A wiring lead 31 connects the valve or switch means 30 to the control means 10.

Figures 2, 3A, 3B:
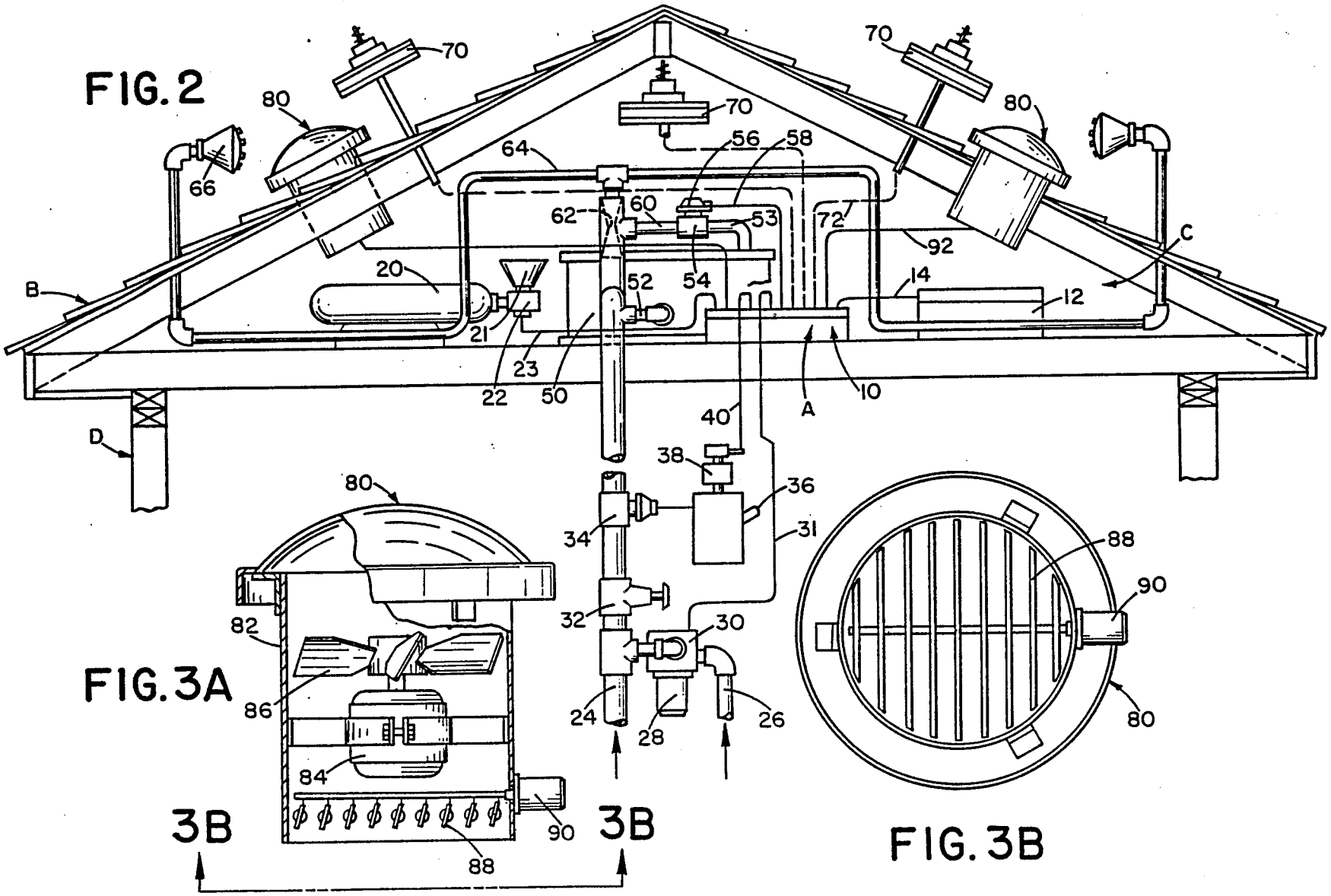
FIG. 2 is a side elevational view of the fire suppression system and roof, in partial cross section, according to FIG. 1.
FIG. 3A is an enlarged size elevational view partially in cross-section, of an attic ventilation fan according to the present invention; and, FIG. 3B is an end elevational view of the fan of FIG. 3A.

With reference now also to FIG. 2, a manual shut-off valve 32 is provided in the water line or water pipe 24 downstream of the auxiliary water supply inlet. A control valve 34 operated by the control means 10 is provided downstream of the manual shut-off valve 32. With reference now also to FIG. 2, the control valve can be manually tripped as at 36 when a fire condition is seen or anticipated so that reliance need not be had exclusively on the fire sensors which will be described below. On the other hand, the control means 10 can actuate the control valve 34 through an automatic trip means 38. A wiring lead 40 connects the control means 10 to the automatic trip means 38.

A fire suppressant liquid tank 50 is provided in the attic C and a water pipe 52 allows water to flow from the water conduit 24 into the tank to pressurize the liquid therein and cause it to flow through a pipe 53 and to a concentrator valve 54. The valve 54 is actuated by a conventional control solenoid 56 through a control wire 58 and controls the amount of fire suppressant fluid that is able to flow through a pipe 60 into a venturi eductor 62 positioned within the water pipe 24. This eductor enables a mixing of the fire suppressant fluid with water before the mixture flows through piping 64 and through a plurality of conventional nozzles 66 positioned on the exterior of the roof B.

The fire suppressant fluid may be a detergent foam, a protein foam, or an aqueous film forming foam such as the LIGHT WATER brand of aqueous film forming foam sold by 3M Corporation. Aqueous film forming foams are particularly advantageous in that they are designed to be used with water and, when proportioned with water and applied with conventional foam or water/fog equipment, the chemical generates a white foam with the ability to make water float on flammable liquids which are lighter than water. The foam spreads over the surface of the burning material forming a blanket in the manner of conventional foams. However, an aqueous solution drains from the foam bubbles and forms a vapor sealing film that floats on the surface of the burning matter and suppresses any volatile vapors, sparks, or the like. Preferably, the fluid has a low surface tension to thus provide excellent penetrating and wetting qualities which can be important in extinguishing wood shingle fires.

A plurality of conventional ultraviolet sensors 70 are provided for sensing a fire condition on the roof B. Two of these are preferably positioned on the outer surface of the roof, one on each side thereof, while a third one is preferably positioned at the apex of the attic C to sense any sparks or the like in the attic. Suitable wiring 72 leads from each of the sensor means 70 to the control means 10. Of course more or less than three such sensors 70 could be provided as circumstances require.

In order to retard the spread of fire in the attic C, the attic is preferably sealed by closing all outside air sources such as by blocking all the air vents. This diminishes air movement in the attic. However, since stagnant air in the attic would, in the summertime, get quite hot, a pair of ventilation fans 80 are provided for the roof B to establish an air circulation pattern in the attic C.

With reference now to FIG. 3A, each of these fan assemblies 80 includes a housing 82, a motor 84, several fan blades 86, as well as louvers or shutters 88, and a control solenoid 90. Suitable wiring 92 leads from the control means 10 to the solenoid. A suitable conventional thermostat (not illustrated) can be provided in the attic to actuate each fan's motor 84 when the temperature in the attic climbs past a selected temperature. It should be noted that the sensor means 70 can be suitably configured to also function as the thermostat for the regulation of the fan assemblies 80 when no fire condition is sensed. When, however, the sensor means 70 senses a fire condition, the solenoid 90 is actuated through the control means 10 to close the shutters 88 (see FIG. 3B) and thereby prevent any further air circulation into or out of the attic through the fan assemblies 80.

In use, when a fire condition is sensed by the sensor means 70, or when the manual trip 36 is activated, power to the motors 84 of the fan assemblies 80 is shutoff and the shutters 88 are closed thereby preventing any further air circulation in the attic C. The control means 10 then actuates the valve 22 of the fire suppressant gas to allow gas to flow out of tank 20 through nozzle 21 and fill the attic with a fire retardant or suppressant gas, such as $CO_2$.

Simultaneously, the automatic trip 38 is actuated by the control means 10 (unless already previously actuated by manual trip 36) to open control valve 34 and allow water to flow through the water pipe 24. Fire suppressant fluid from tank 50 is urged to flow into and be mixed with the water in the venturi eductor 62 from which the water and fire suppressant fluid combination flows through piping 64 and nozzles 66 onto the shingles on the exterior of the roof B. If the shingles are already burning, then the water-fire suppressant fluid mixture will tend to put the flame out. If the shingles are not yet ignited, then the mixture will tend to prevent such ignition from taking place. Thus the potential roof fire is either prevented from occuring at all or is extinguished very quickly thereby saving the roof of the building and hence the units therewithin.

It should be noted that if the manual trip 36 is activated, the control means will sense this and actuate the valve 22 of the fire suppressant gas in the attic just as with the automatic operation thereof.

The invention has been described with reference to a preferred embodiment. Obviously, alterations and modifications will occur to others upon a reading and understanding of this specification. It is intended to include all such modifications and alterations insofar as they come within the scope of the appended claims or the equivalents thereof.

What is claimed is:

1. A method for extinguishing a fire on a roof, such as a wood shingle or shake roof, comprising the steps of:

sensing a fire condition;

actuating a closure means for sealing an air path to an attic beneath the roof against the inflow of air through said air path, wherein said step of actuating is performed by an automatic logic circuit; and injecting a fire retardant gas in the attic.

2. The method of claim 1 further comprising the step of spraying a fire retardant liquid on an exterior surface of the roof.

3. The method of claim 2 further comprising the steps of:

providing a supply of a fire retardant chemical;

providing a supply of water; and, mixing said fire retardant chemical and said water prior to said step of spraying.

4. A fire extinguishing system for protecting a building attic and roof from fire, comprising:

a fire sensor for monitoring a fire condition;

a ventilation fan for the attic which fan is secured on the roof and communicates through an air intake with the attic and a means for closing the air intake of said ventilation fan upon the sensing of a fire condition by said fire sensor to prevent said fire from spreading;

an automatic logic circuit which communicates with said fire sensor and said means for closing the air intake to regulate said means for closing the air intake;

a supply of a fire retardant fluid; and, a nozzle located in the attic and connected to said supply of fluid and including a valve which regulates an injecting of the fire retardant fluid into the attic by said nozzle upon the sensing of a fire condition by said fire sensor, wherein said automatic logic circuit also communicates with said valve.

5. The system of claim 4 wherein said means for closing the air intake comprises:

a plurality of shutter members each of which is rotatably secured in a side by side manner adjacent each other and adjacent the air intake;

a connecting rod which connects said plurality of shutter members together so that they can be operated in unison; and, a means for actuating said connecting rod.

6. The system of claim 5 wherein said means for actuating comprises a solenoid.

7. The system of claim 4 further comprising a means for deenergizing said ventilation fan upon the sensing of a fire condition.

8. A fire extinguishing system for enclosed areas, such as an attic beneath a roof, comprising:

a ventilation fan extending through a wall of an enclosed area and defining an air path into and out of the enclosed area, said fan including a frame and a selectively operable means secured to the frame for moving air through the air path;

a temperature sensor associated with said fan for monitoring a fire condition; and, a means for selectively closing the air path of said ventilation fan as directed by said temperature sensor wherein said means for closing comprises:

a solenoid secured to said fan housing; and, at least one movable shutter member operatively connected to said solenoid.

9. The system of claim 8 further comprising:

an actuator rod; and, a connecting means for connecting said actuator rod to said at least one shutter member, wherein said solenoid is operatively connected to said actuator rod.

10. The system of claim 9 wherein a plurality of shutter members are provided in a side by side relationship.

11. The system of claim 8 wherein said means for moving air comprises a motor and at least one fan blade adapted to be rotated by said motor.

12. The system of claim 11 further comprising a means for selectively deenergizing said motor.

13. The system of claim 8 further comprising:

a fire retardant gas storage container;

a valve for regulating the venting of fire retardant gas from said container into the enclosed area; and, a means for controlling the operation of said valve.

14. A method for preventing a fire in an attic comprising:

providing a building roof having an attic underneath with a ventilation fan for the attic, said fan being secured to the roof and having an air path to the attic;

providing a means for selectively closing the air path to prevent communication between the attic and the environment;

providing an automatic logic circuit which regulates said means for selectively closing;

sensing a fire condition; and, closing said air path through the actuation of said means for selectively closing by said automatic logic circuit.

* * * * *